United States Patent [19]

Juhasz et al.

[11] 4,376,146

[45] Mar. 8, 1983

[54] WEFT INSERTION KNITTED SECONDARY CARPET BACKING

[75] Inventors: Tibor Juhasz, Summerville; Hans E. Heyn, Summerton, both of S.C.

[73] Assignee: Exxon Research & Engineering Co., Florham Park, N.J.

[21] Appl. No.: 233,577

[22] Filed: Feb. 11, 1981

[51] Int. Cl.[3] ..... B32B 3/02; B32B 33/00

[52] U.S. Cl. ..... 428/95; 428/253

[58] Field of Search ..... 428/95, 253; 66/170, 66/192, 193, 195, 202

[56] References Cited

U.S. PATENT DOCUMENTS 3,853,680 12/1974 Daniel ..... 428/95

4,145,467 3/1979 Malik ..... 428/95

*Primary Examiner*—Marion McCamish

*Attorney, Agent, or Firm*—J. R. Nelson; R. L. Graham

[57] ABSTRACT

A secondary carpet backing for adherence to the underside of a carpet material via an adhesive. The secondary carpet backing comprises a weft inserted knit material having a series of warp yarns forming spaced rows of warp-wise extending chain stitches, and a series of weft yarns forming spaced rows extending transversely of the series of warp yarns. The weft yarns are laid in the chain stitches and serve to interconnect adjacent rows of the warp yarns. The warp yarns have a denier in the range of 300–700 and the weft yarns have a denier in the range of 1300–2300. Such a secondary carpet backing exhibits improved adhesion characteristics when adhered to the underside of a carpet material with a conventional adhesive.

15 Claims, 4 Drawing Figures

WEFT INSERTION KNITTED SECONDARY CARPET BACKING

BACKGROUND OF THE INVENTION

The present invention relates to secondary carpet backings for adherence to the underside of a carpet material by an adhesive, and in particular to an improved secondary carpet backing which has improved adhesion characteristics.

As is known in the art, it is often desirable to apply secondary backings to the bottom surface or underside of a carpet material to add dimensional stability, weight and durability to the formed carpet structure. Such secondary backing materials have traditionally been made of woven jute. More recently, however, due to the difficulties in obtaining a reliable source of jute and its highly variable costs, manufacturers have sought to find a suitable replacement. One material that has many of the requisite physical properties for the secondary backing, and is available at a reasonable price, is woven synthetic scrim of the type that is commonly used for the primary carpet backing. Generally, both the warp-wise and weft-wise yarns of such woven backing structures are made of a synthetic material, such as for example, oriented polyolefin filaments which are woven in accordance with conventional weaving techniques to form the backing structure. However, because of the smooth, slippery and generally impervious nature of such polyolefin yarns, commercially available latex adhesives do not always form strong bonds between the synthetic yarn backing fabrics and the underside of the primary carpet material. It should be noted that such problems of adhesion are generally minimized when such synthetic yarns are used for the primary backings since such primary yarns generally have fiberous pile yarns piercing the primary backing which are highly receptive to the latex adhesives.

Various techniques have been employed in the past to improve the adhesion characteristics of such secondary carpet backings utilizing synthetic yarns or materials. For example, one technique which is quite common is to employ spun yarns made of synthetic fibers as the fill or weft-wise yarns in the woven secondary carpet backing. Such spun yarns are made from a multitude of relatively short fibers which are spun together to produce a synthetic yarn having a "hairy" appearance. These spun yarns may then be woven together with synthetic warp yarns which may comprise flat ribbons or tapes of synthetic material. For instance, one such typical woven structure is produced utilizing a leno weave process in which the warp yarns are arranged in pairs and woven in a manner so that the pairs of warp yarns are twisted between each weft yarn. As a result of the hairy construction of the weft yarns, improved adhesion of the adhesive for adhering the secondary backing to the primary backing is achieved.

Another similar technique for improving the adhesion characteristics has been the employment of heavily fibrillated yarns having a multitude of fibrils or splinters therealong as the weft or fill yarns in woven secondary backing constructions (see for example U.S. Pat. Nos. 3,542,632 and 4,145,467). In these techniques, it is contemplated that the latex adhesives will more readily adhere to the created fibrils or splinters.

A still further technique which has been employed in an attempt to improve the delamination or peel resistance characteristics of secondary carpet backings is disclosed in U.S. Pat. No. 3,817,817. In accordance with the method of that patent, a layer of staple fibers is needled onto the bottom surface of the scrim or secondary backing with portions of the fibers projecting through the top surface of the secondary carpet backing to provide a product which has the appearance of being jute and to which the latex adhesive can readily adhere or attach.

As can be appreciated, however, each of these prior art techniques requires the use of special types of filaments or the treating of same which are then utilized in forming a woven fabric structure. Also, because the filaments had to be specially treated prior to the weaving operation or subsequent thereto, it will be appreciated that such prior art techniques serve to significantly increase the cost of the resulting secondary carpet backing structure.

It is important to note in this regard that all of the secondary carpet backings of the prior art have generally comprised fabric structures which are woven from filaments of synthetic material. While knitted arrangements or fabric structures have been utilized for the primary carpet backings (see for example U.S. Pat. No. 3,732,708), secondary carpet backings have not previously employed weft inserted knit structures, possibly because of the relatively high denier filaments which are required in secondary carpet backing applications for providing the necessary strength, weight and durability and the fact that it has not previously been realized that improved adhesion characteristics can be achieved therewith.

SUMMARY OF THE INVENTION

In accordance with the present invention, there is provided an improved secondary carpet backing for adherence to the underside of a carpet material by adhesive in which the secondary carpet backing comprises a weft inserted knit material having a series of warp yarns forming spaced rows of warp-wise extending chain stitches and a series of weft yarns forming spaced rows extending transversely of the series of warp yarns. The weft yarns are laid in the chain stitches and serve to interconnect adjacent rows of the warp yarns. In accordance with the present invention, the warp yarns preferably have a denier in the range of 300–700, and the weft yarns have a denier in the range of 1300–2300. In this regard, conventional weft inserted knit structures for applications other than secondary carpet backings typically have warp yarns which have a denier generally below 200.

As a result of the weft inserted knit structure of the secondary carpet backing in accordance with the present invention, the surfaces of the resulting structure have a complex curvature which exhibits improved delamination or peel strength characteristics when an adhesive is applied thereto and the secondary carpet backing structure is adhered to the underside of the primary carpet backing. The complex curvature on the surfaces of the resulting fabric is the result of the fact that the warp yarns which run in the machine direction are twisted during the knitting operation about the weft yarns, and as such, provides for an improved mechanical locking or anchoring of the latex which will be utilized to secure the secondary carpet backing material to the primary backing.

In the preferred embodiment, the warp and weft yarns comprise yarns made of an oriented polyolefin material having a high tensile strength. Preferably, the warp yarns comprise flat tapes or ribbons having a generally rectangular cross-section. The weft yarns may either comprise flat synthetic yarns or monofilament yarns having a round or other type of cross-section, or if desired may comprise bonded filaments. In either event, however, the resulting structure possesses the desirable high tensile strength and at the same time exhibits improved adhesion characteristics when adhered to the underside of a carpet backing with conventional adhesives. Further in this regard, the speed of operation utilizing a weft inserted knit technique is much greater than conventional production rates for woven carpet backings. Still further, in a weft inserted knit structure, the warp yarns are wrapped around and knitted about the weft yarns, in contrast to woven structures in which the weft yarns are simply held in place as a result of the warp yarns being passed about either side of the weft yarns. Consequently, with a weft inserted knit structure, the weft yarns are not as capable of being pulled out of the fabric structure.

These and further features and characteristics of the present invention will be apparent from the following detailed description in which reference is made to the enclosed drawings which illustrate a preferred embodiment of the present invention.

DETAILED DESCRIPTION OF THE PREFERRED EMBODIMENT

Figure 1:
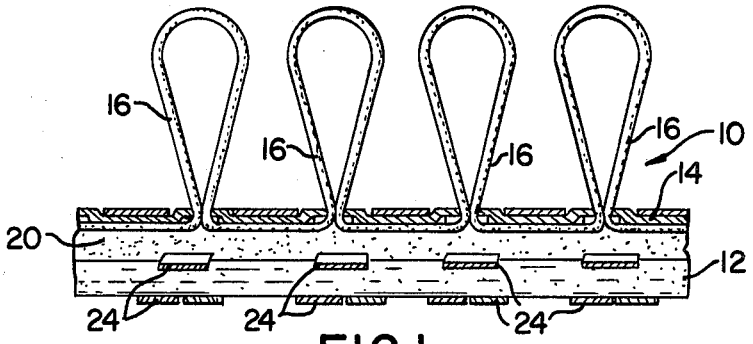
FIG. 1 is a side elevational view of a double backed carpet structure in which there is provided a primary backing having yarns tufted therethrough and to the underside of which is adhered a secondary carpet backing in accordance with the present invention.

Referring now to the drawings wherein like reference characters represent like elements, there is shown in FIG. 1 a carpet material 10 which includes a secondary carpet backing 12 formed in accordance with the present invention. Although the secondary backing 12 of the present invention is particularly well suited for the particular type of tufted carpeting shown and described hereinbelow, it also is equally applicable for use with any other tufted woven carpet or other type of carpet material, and the particular type of carpeting is not part of the invention herein.

As is well known, the carpet material 10 includes a primary backing 14 to which tufts or pile fibers 16 may be adhered to form the carpeted surface of the finished carpet material 10, and a secondary backing 12 adhered to the underside of the primary backing 14 to add dimensional stability, weight and durability to the overall carpet 10. Although not shown in FIG. 1, the primary backing 14 may include a layer of dyeable staple fibers which are adhered to the top surface of the primary backing 14, such as for example by needling same through the top surface. The primary backing 14 also has a series of tufts 16 which extend up through the primary backing 14 and which form the carpet face proper. Any suitable material may be used for the tufts 16, although normally they are nylon or acrylic materials, and are dyeable. The base portions of the tufts 16 are on the underside of the primary backing 14 and are preferably locked in place by a layer of suitable latex or adhesive 20, such as the adhesive for adhering the secondary backing 12 to the primary backing 14. The tufts 16 may be of any desired length and density, and may be looped, as shown, or cut.

The secondary backing 12 is normally conventionally bonded to the underside of the primary backing 14, usually as a last step in the manufacture of the end product, by means of a suitable adhesive layer 20 which may be any suitable type of adhesive, such as the normally used commercially available latex adhesives. The adhesive layer 20 normally runs into and adheres to the bases of the tufts 16, and any number of conventional backing adhesives may be utilized to secure and bond secondary backing 12 to the primary backing 14.

It will be appreciated that in order to provide the desired dimensional stability, weight and durability afforded by the use of secondary carpet backings, it is necessary that the secondary backing 12 be capable of being securely bonded to the underside of the primary backing 14 in a manner such that it will not easily peel apart or away from the primary backing 14 during use. This becomes a particular problem when the secondary carpet backing 12 is manufactured from synthetic filaments since such synthetic filaments are often smooth and slippery, often making it difficult for the adhesive 20 to be secured or "locked" to the secondary carpet backing 12. At the same time, it is preferable that the cost of the secondary carpet backing 12 be minimized, not only from the standpoint of the cost of the synthetic materials comprising the secondary backing 12, but also the cost involved in the manufacture or production of same.

In accordance with the present invention, the secondary carpet backing 12 comprises a weft inserted knitted structure 22 which includes a series of warp yarns 24 forming spaced rows of warp wise extending chain stitches 26 and a series of weft yarns 28 forming spaced rows of weft yarns extending transversely of the series of warp yarns 24. The weft yarns 28 are laid in the chain stitches 26 and serve to interconnect adjacent rows of the warp yarns 24. In order to provide the desired durability, weight and dimensional stability, the warp yarns 24 preferably have a denier ranging between 300–700, and the weft yarns 28 have a denier in the range of 1300–2300. As is known in the art, the denier of a yarn refers to the fineness of the yarn, lower denier yarns being finer than higher denier yarns.

As a result of the weft inserted warp knitted structure 22, the secondary carpet backing 12 in accordance with the present invention has a complex curvature on the surfaces thereof which is most advantageous in providing for improved adhesion characteristics over conventional woven secondary carpet backing structures. In essence, the complex curvature or nonplanar character of the surfaces of the secondary carpet backing 12 provides for greater mechanical locking or anchoring to the secondary carpet backing 12 of the latex adhesive which is used to secure the secondary carpet backing 12 to the primary carpet backing 14. As a consequence, it is not necessary to use special weft yarns to ensure a suitable adhesion characteristics.

More particularly, in the preferred embodiment, the warp yarns 24 comprise flat ribbons or filaments of an oriented polyolefin material such as polypropylene. Typically, the warp yarns 24 are 2–5 mils in thickness and 1/32-⅛" in width, and have a denier which is approximately 300–700 and more preferably 500. As is well known, such oriented polyolefin filaments have a high tensile strength which will be imparted to the resulting structure 22 in which it is knitted. The weft or fill yarns 28 likewise preferably comprise oriented filaments of a polyolefin material, but need not necessarily comprise any special structure, such as multifilament strands which are spun bonded and used in the prior art woven secondary carpet backings. Rather, the weft yarns 28 may comprise either round monofilaments, or flat ribbons or tapes, as well as more conventional multifilament strands which are spun or twisted together. The weft yarns 28 have a much higher denier than the warp yarns 24, on the order of 1300–2300, and more preferably from 1500–2000, in order to provide for increased weight and durability for the resulting knitted structure 22.

Figure 2:
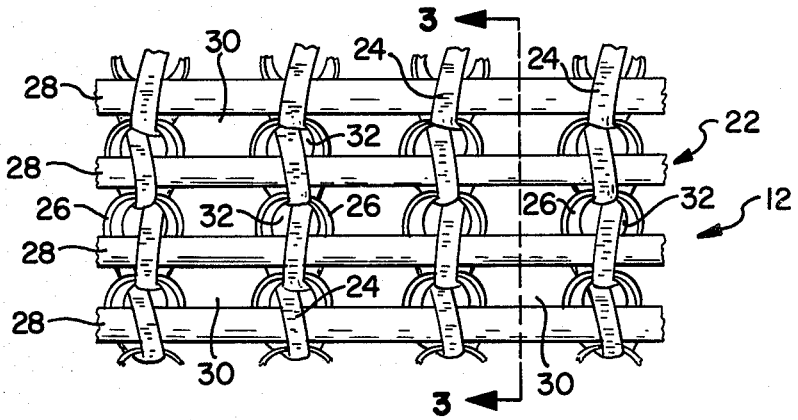
FIG. 2 is a plan view, on a greatly enlarged scale, of a weft inserted knitted secondary carpet backing in accordance with the present invention, illustrating one typical chain stitch which may be utilized for the warp yarns.

As best seen in FIG. 2, the weft inserted knit material 22 comprises a plurality of warp yarns 24 which have been knitted to provide a plurality of longitudinally extending chain stitches 26 extending in the warp direction. Typically, the spacing for the warp yarns is between 10–20 yarns per inch. The weft yarns 28 are adapted to be laid in each of the chain stitches 26 as they are knitted so as to interconnect adjacent rows of warp yarns 24. In the preferred embodiment, a conventional ladder or pillar chain stitch 26 is used for the knitting of each of the warp yarns or filaments 24 about the transversely extending weft yarns 28, one weft yarn 28 being provided for each of the knitted warp-wise extending chain stitches 26. Typical spacing of the weft yarns is 5–15 yarns per inch. Although in the preferred embodiment, each of the warp yarns 24 is only interconnected to adjacent warp yarns 24 by virtue of the laid-in weft yarns 28, it will be appreciated that other types of conventional knitting stitches may be utilized in which adjacent rows of warp yarns 24 are interconnected together by virtue of the chain stitches as well. For example, trico or raschel type knitting stitches could be employed.

Figure 3:
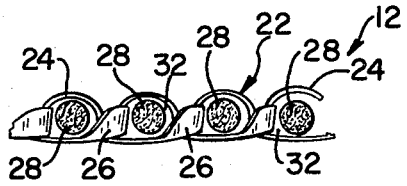
FIG. 3 is a side elevational view, on a greatly enlarged scale, of a section of the secondary carpet backing shown in FIG. 2, illustrating the nature of the surface of the weft inserted knitted structure which advantageously produces improved adhesion characteristics for the weft inserted knitted fabric.

As can be appreciated, when flat polyolefin filaments or tapes comprise the warp yarns 24, the flat filaments or tapes are twisted or turned during each knitting stitch, thereby providing highly complex surface curvatures or structures for the resulting weft inserted knitted structure 22. That is, the warp yarns 24 periodically extend in and out of the plane of the resulting structure 22, thereby providing a very highly textured, nonplanar surface for the resulting fabric 22 (see FIG. 3 which is a cross-section of the secondary carpet backing 12 and which illustrates the complex surface configuration). In this regard, both sides of the structure 22 have a textured nonplanar surface and thus exhibits improved adhesion characteristics. As a result of this complex curvature or textured surface, particularly when coupled with the fact that the warp and weft yarns 24, 28 are spaced apart and the fact that the warp yarns 24 are knitted about the weft yarns 28, there is provided a multitude of open areas 30 between adjacent warp and weft yarns 24, 28 and a plurality of interstices 32 within each chain stitch 26 to which the latex adhesive 20 for adhering the secondary carpet backing 12 to the primary backing 14 may be mechanically locked or anchored into the secondary carpet backing 12. This is most important in providing for a secure bond between the secondary carpet backing 12 and the primary backing 14.

Here, it is to be noted that such conventional latex adhesives 20, because of the slippery and smooth nature of the synthetic filaments, do not inherently provide for good mechanical locking or anchoring of the adhesive to the filaments when the filaments are woven in a conventional manner, such as for example utilizing a leno-type weaving process in which the warp yarns comprise flat filaments which are simply twisted during the formation of the leno woven secondary carpet backings. Consequently, with such prior art woven structures utilized for secondary carpet backings, it has been necessary to utilize specialized fill yarns or weft yarns which have a plurality of fine fibrils or fibers extending from the surface thereof to which the latex adhesive may adhere in order to provide the necessary desired peel strength and adhesive characteristics for secondary carpet backings. For example, commonly spun fill yarns are utilized in which a plurality of relatively short fibers are spun into a longitudinally extending yarn in a conventional manner with conventional spinning equipment, such as commonly used in making yarns from natural fibers. Such specialized type of spun fill yarns are not necessary in accordance with the weft inserted knit structure 22 of the present invention in which flat filament tapes or ribbons are used as the warp-wise yarns 24. Rather, synthetic monofilament yarns or even flat ribbon yarns may be used as the weft yarns 28.

In this regard, with the weft inserted knit structure 22 in accordance with the present invention, the peel strength or delamination resistance of the secondary carpet backing 12 is on the order of 25% higher than the peel strength of conventional leno woven secondary carpet backings using similar types of warp and weft yarns, i.e., warp yarns 24 comprising flat tapes or ribbons and weft yarns 28 comprising spun fibers. Still further, the peel strength characteristics of the weft inserted knit secondary carpet backing 12 in accordance with the present invention in which a non-spun fill yarn or weft yarn 28 is utilized (i.e., a monofilament or flat ribbon weft yarn 28) is still greater than the peel strength of conventional leno woven secondary carpet backings which utilize a spun fill yarn. Here, it should be noted that spun fill yarn is quite expensive, on the order of 30% more than flat polypropylene yarn, and thus substantial material cost savings can be realized with the present invention while at the same time providing an improved or at least comparable structure in terms of adhesion characteristics.

Still further, because the warp-wise yarns 24 are knitted or twisted about the weft yarns 28, the weft yarns 28 will be tightly gripped by the twisted warp yarns 24 such that they will not easily pull out of the knitted structure 22. In essence, the warp-wise yarns 24 are wrapped around and knitted about the weft yarns 28. This is in contrast to conventional leno woven structures in which the weft yarns are simply encased between a pair of warp yarns located at approximately the same location. Thus, it will be appreciated that the weft inserted knit structure 22 in accordance with the present invention serves to more tightly hold and retain the weft yarns 28 in place.

Figure 4:
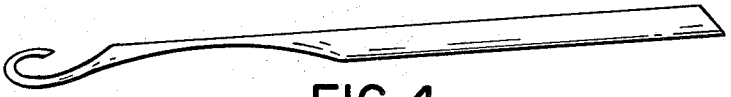
FIG. 4 is a side view of a modified knitting needle which may be utilized in a weft insertion knitting apparatus for providing a weft inserted knitted secondary carpet backing in accordance with the present invention.

In this regard, it has been found that a conventional weft inserted knitting apparatus such as manufactured by Liba GmbH may be utilized after minor modifications to make a weft insered knit structure 22 in accordance with the present invention. More particularly, one modification comprised replacing the beamettes of a conventional weft inserted knitting apparatus with a "Sulzer" type loom beam generally used in weaving. A second change involved modifying the knitting needles utilized in the weft inserted knitted equipment so as to have a structure such as that shown in FIG. 4. This structure was necessary in order to strengthen the needles to prevent breakage thereof and to be able to grasp and hold the flat filaments utilized for the warp yarns 24. Further, the spacing between the knitting needles was modified so as to be no less than the width of the warp yarns 24, and preferably to be spaced approximately twice the width of the warp yarns 24. For example, four gauge spacing of the needles was utilized for knitting of the structure 22 shown in FIG. 2. Further, a hold down bar or sinker was provided immediately following the stitching or knitting operation to prevent rising of the loops within the needles. Such sinkers have been utilized previously in connection with weft inserted knitting techniques. Finally, the tension applied to the warp yarns 24 and the angle of take off after the stitching operation was modified to help loop formation and prevent rising of the loops. In this regard, the take off angle from the knitting needles was modified so that the take off was inclined downwardly at a suitable angle, for example from 15°–30°, from the horizontal.

With these modifications, all of which could be accomplished by persons having ordinary skill in the knitting art, it is possible to convert a conventional weft inserted knitting machine into one which can accommodate the increased denier of the warp and weft yarns 24, 28 which are utilized for the manufacture of secondary carpet backings 12 in accordance with the present invention.

The secondary carpet backing 12 in accordance with the present invention provides a highly satisfactory backing not only from the standpoint of weight, strength and adherability, but in addition, the secondary carpet backing may be produced at a greater rate of speed. For instance, with conventional leno woven structures which have previously been utilized for secondary carpet backings, the production rate is generally on the order of 180 pics per minute which translates to a production rate of approximately 22.5 inches per minute assuming approximately 8 pics or yarns per inch. However, with the weft insertion techniques of the present invention, the speed of production is much higher and may be on the order of 700 pics per minute which translates to a production rate of approximately 75–80 inches per minute utilizing a conventional weft insertion knitting machine which has been modified in the manner as noted hereinabove. Also, because the weft inserted knitted structure 22 of the present invention may utilize flat ribbons or monofilaments for the weft or fill yarns 28, and not necessarily spun fill yarns, the cost of the materials may be significantly less.

Accordingly, there is provided in accordance with the present invention an improved secondary carpet backing 12 for adherence to the underside of a primary carpet backing 14 by an adhesive. The secondary carpet backing 12 comprises a weft inserted knitted material 22 having a series of warp yarns 24 forming spaced rows of warp-wise extending chain stitches 26 and a series of weft yarns 28 forming a series of spaced rows extending transversely of the series of warp yarns 24, the weft yarns 28 being laid in the chain stitches 26 of the warp yarns 24 and serving to interconnect adjacent rows of the warp yarns 24 to provide a coherent structure. The warp yarns 24 preferably have a denier on the order of 300–700, and the weft yarns 28 have a denier in the range of 1300–2300. Also, preferably, the warp and weft yarns 24, 28 are both comprised of highly oriented polyolefin filaments which exhibit a high tensile strength and which thereby impart, when knitted into the weft inserted knit structure 22 of the present invention, a secondary carpet backing 12 having a high tensile strength in the warp and weft directions.

While the preferred embodiment of the present invention has been shown and described, it will be understood that such is merely illustrative and that changes may be made without departing from the scope of the invention as claimed.

What is claimed is:

1. A carpet structure comprising:

a primary carpet backing having a first surface having pile fibers extending therefrom and secured to said primary carpet backing, and a second surface; and a secondary carpet backing adhesively secured to said second surface of said primary carpet backing, said secondary carpet backing comprising a weft inserted knit material having a series of warp yarns forming spaced or interconnected rows of warp-wise extending knitted stitches and a series of weft yarns forming a series of spaced rows extending transversely of said series of warp yarns, said weft yarns being laid in said knitted stitches and interconnecting adjacent rows of said warp yarns.

2. The carpet structure of claim 1 wherein said warp yarns are made of an oriented polyolefin material.

3. The carpet structure of claim 2 wherein said warp yarns comprise flat filaments of polyolefin material.

4. The carpet structure of claim 3 wherein said weft yarns are made of an oriented polyolefin material.

5. The carpet structure of claim 4 wherein said weft yarns are made from a monofilament polyolefin material.

6. The carpet structure of claim 5 wherein said weft yarns comprise flat ribbons of polyolefin material.

7. The carpet structure of claim 4 wherein said flat filaments comprising said warp yarns are twisted to provide a complex curvature for the surface of said weft inserted knit material.

8. The carpet structure of claim 1 wherein said warp yarns and said weft yarns are made from a polypropylene material.

9. The carpet structure of claim 1 wherein said warp yarns have a denier of approximately 500.

10. The carpet structure of claim 1 wherein the spacing of said warp yarns is in the range of 10–20 yarns per inch.

11. The carpet structure of claim 10 wherein the spacing of said warp yarns is in the range of 5–15 yarns per inch.

12. The carpet structure of claim 1 wherein said warp-wise extending knitted stitches comprise ladder chain stitches.

13. The carpet structure of claim 1 wherein the knitted stitches are chain stitches and the warp yarns form spaced rows of warp-wise extending chain stitches.

14. The carpet structure of claim 1 wherein said warp yarns have a denier in the range of 300–700 and said weft yarns have a denier in the range of 1300–2300.

15. The carpet structure of claim 1 wherein said knitted stitches are tricot stitches.

* * * * *